United States Patent [19]

Li et al.

[11] 4,183,681

[45] Jan. 15, 1980

[54] EMULSION PREPARATION METHOD USING A PACKED TUBE EMULSIFIER

[75] Inventors: Norman N. Li, Edison; Taras Hucal, Iselin, both of N.J.

[73] Assignee: Exxon Research & Engineering Co., Florham Park, N.J.

[21] Appl. No.: 907,549

[22] Filed: May 19, 1978

[51] Int. Cl.[2] ..... B01F 3/08; B01F 5/00

[52] U.S. Cl. ..... 366/336; 366/348

[58] Field of Search ..... 366/336, 337, 338, 339, 366/348

[56] References Cited

U.S. PATENT DOCUMENTS

| | | | |
|---|---|---|---|
| 2,504,678 | 4/1950 | Gardner | 366/336 |
| 2,894,732 | 7/1959 | Taber et al. | 366/336 |
| 3,416,320 | 12/1968 | Asher | 366/336 X |
| 3,550,912 | 12/1970 | Eikhenvald | 366/339 |
| 3,704,006 | 11/1972 | Grout et al. | 366/339 X |
| 3,773,098 | 11/1973 | Rock | 366/339 X |
| 3,865,352 | 2/1975 | Nelson et al. | 366/336 |
| 3,918,688 | 12/1975 | Huber et al. | 366/336 |
| 4,019,719 | 4/1977 | Schuster et al. | 366/338 |
| 4,049,241 | 9/1977 | Taniguchi | 366/339 |
| 4,093,188 | 6/1978 | Horner | 366/336 |

FOREIGN PATENT DOCUMENTS

| | | | |
|---|---|---|---|
| 1020190 | 2/1966 | United Kingdom | 366/336 |

*Primary Examiner*—Stanley N. Gilreath

*Attorney, Agent, or Firm*—Joseph J. Allocca

[57] ABSTRACT

Emulsions are prepared utilizing an emulsification device comprising an enclosure having orifices thereby permitting flow of a fluid through the enclosure along one of its axis, of any cross-section profile perpendicular to its axis for fluid flow, which enclosure is packed with a material which causes the flow of fluids to be broken down into many fine streams which fine streams, being in intimate contact one with the other, remix rapidly and repeatedly, resulting in the formation of the desired emulsion. The fluids which are mixed in the packed enclosure are fed to the enclosure by fluid feeding means such as pumps or by gravity feed tanks and conduits communicatively attached to the packed enclosure. The fluids fed into the packed enclosure are introduced into the enclosure in close proximity one to another so as to insure maximum intermixing of the different fluids.

35 Claims, 1 Drawing Figure

PACKED TUBE EMULSIFIER

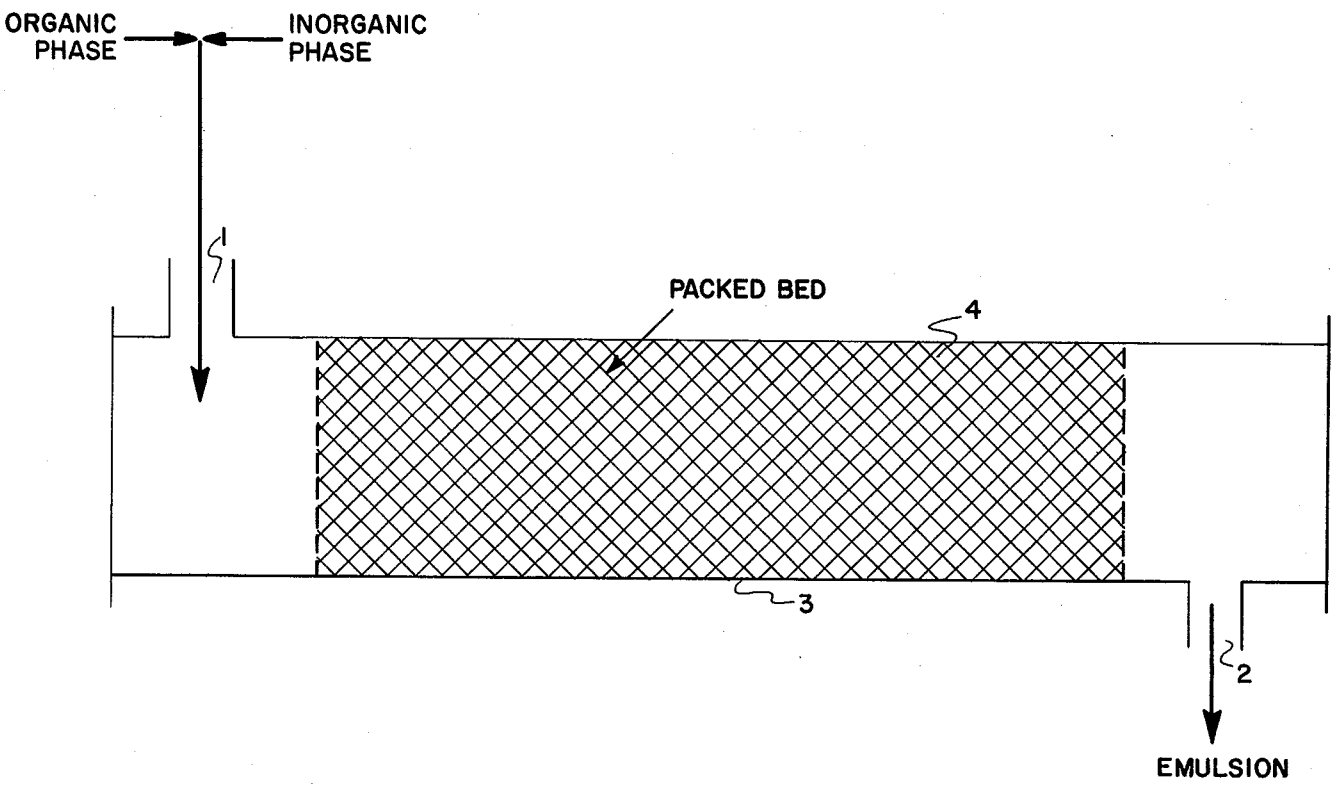
FIGURE I
PACKED TUBE EMULSIFIER

EMULSION PREPARATION METHOD USING A PACKED TUBE EMULSIFIER

DESCRIPTION OF THE INVENTION

Emulsions are prepared utilizing an emulsification device comprising an enclosure having a multiplicity of orifices, at least one of which orifice is an entrance orifice into which entrance orifice or orifices is introduced a number of fluids and at least one of which is an exit orifice located at a maximum distance from the other orifice or orifices, thereby permitting the flow of fluids through the enclosure along one of its axis, which enclosure is of any cross-sectional profile perpendicular to the axis of fluid flow, which enclosure is packed with a material which causes the flow of the fluids to be broken down into many fine streams, which fine streams, being in intimate contact one with the other in the enclosure, and remix rapidly and repeatedly, resulting in the formation of the desired emulsion which is discharged from the exit orifice or orifices.

The immiscible fluids which are introduced into the packed enclosure through the entrance orifice or orifices are fed into the packed enclosure by fluid feeding means selected from the group consisting of pumping means, gravity conduit means, syringe means and combinations thereof, in communication with fluid storage means such as tanks or reservoirs, etc. Preferably single or multiple pumps are used. The fluids fed into the packed enclosure are introduced into the enclosure either through the same entrance orifice serviced by the fluid feeding means or each fluid through individual entrance orifices in close proximity one to another so as to insure maximum intermixing of the different fluids.

Any number of packed enclosure emulsion generators can be used, with each generator mixing two or more fluids, or a single generator can be used with the fluids introduced either simultaneously through a single entrance orifice or with each fluid fed into the packed enclosure through individual entrance orifices situated on the apparatus, it being preferred that all fluids desired to be mixed are fed into the enclosure simultaneously. If necessary, however, the individual fluids can be fed into the enclosure sequentially. The packed enclosure can also be equipped with a return loop conduit whereby either all or part of the emulsion exiting the exit orifice is reintroduced into the entrance orifice for recirculation through the packed enclosure either alone or along with added component fluids. In this way a higher degree of emulsification can be obtained if desired. It is most preferred that separate packed enclosure emulsifiers be used to prepare individual emulsions when the final emulsion comprises a multiple emulsion, such as a water/oil/water system.

DESCRIPTION OF THE FIGURE

FIG. I is a schematic showing a typical packed tube emulsifier which can be used in the method of the instant invention wherein the arrow pointing into an opening indicates the entrance (1) into which the immiscible fluids are simultaneously introduced for passage through the enclosure (3) to the exit (2), indicated by the arrow pointing away from the enclosure (3), fluid flow being through the enclosure in the direction resulting from the indicated mode of fluid introduction. The cross hatching (4) in the enclosure (3) represents the packing filling the enclosure which may be any of the packings described in greater detail below and recited as operable in the method.

BACKGROUND OF THE INVENTION

Emulsions can be simplistically visualized as one discontinuous internal phase or fluid enveloped in a second dissimilar continuous external phase or fluid. In general, emulsions fall into two broad categories, oil in water emulsions wherein the oil is the discontinuous internal phase and the water is the continuous external phase, or a water in oil emulsion, where the above rules are reversed. In addition there can be multiple emulsions such as water-oil-water emulsion wherein there is a discontinuous internal water phase, surrounded by a discontinuous external oil phase suspended in a continuous water external phase; or an oil-water-oil multiple emulsion wherein the above roles are reversed, i.e., in all liquid membrane systems.

Emulsions, whether they are water in oil or oil in water are further characterized as being low ratio or high ratio. Low ratio emulsions are generally no higher than 4/1 internal phase to external phase whereas high ratio emulsions are normally greater than 4/1, preferably greater than 8/1 internal phase to external phase. Low ratio emulsions possess very small droplet sizes, usually on the order of $1\mu$, while high ratio emulsion possess relatively larger particle sizes on the order of $20\mu$ or more.

To make the low ratio type emulsions, many kinds of emulsification devices are available commercially, such as Tekmar Super Dispax, colloid mill, ultrasonic vibrator, etc. These devices are, however, very expensive. The simple and inexpensive features of the disclosed invention, which consists of an ordinary pump and a packed tube, are obvious. To make the high ratio type emulsions, especially the very high ratio ones, such as 17/1 W/O emulsion, there is no simple, effective, and inexpensive device available except the disclosed invention. The inability of the currently available emulsification machines in making the latter type emulsions is largely because the machines are too powerful to produce and maintain large droplets. They are made basically to produce emulsions composed of very fine droplets.

The instant invention is directed to a method for the preparation of emulsions and/or multiple emulsions utilizing an apparatus. The apparatus comprises an enclosure, typically a pipe or column. This enclosure can be of any cross-sectional profile, i.e., any regular or irregular multi-sided configuration of n sides wherein n ranges from 3 to $\infty$ (i.e., circular). The enclosure has orifices so as to permit the entrance of fluids and the exit of said fluids. These orifices can be either the normal open ends of a piece of pipe or, if the enclosure has no "normally" open end the orifice can be specially constructed in the wall of the enclosure. What is necessary is that there be at least one entrance orifice and one exit orifice. Preferably these entrance and exit orifices are situated at the maximum possible distance away from each other along the axis of fluid flow in the enclosure so as to insure maximum mixing between the fluids introduced into the enclosure. It is possible, and in some instances desirable, that there be multiple entrance orifices in which case each individual fluid can be introduced into the enclosure through its own entrance orifice. When multiple entrance orifices are employed they can be either serially located parallel to the fluid flow or radially in the enclosure wall in the perimeter of the enclosure defined by a plane passing perpendicular to the direction of flow in the enclosure.

The enclosure is packed with a material which causes the fluids introduced into the enclosure through the entrance orifice to split into many fine streams and to remix rapidly and repeatedly resulting in the formation of the desired emulsion. This material with which the enclosure is packed is packed into the enclosure in a random manner to as high a degree of density as is possible, short of plugging the enclosure, i.e., the fluid pressure drop between the entrance and exit may not equal zero. Suitable packing material is selected from the group consisting of steel metal sponge (such as Kurly Kate), metal shavings, ceramic chips, Berl Saddle (porcelin forms available from Fisher stock #9-191-5), animal hair or plastic brush, metal tubes shorter than the internal diameter of the enclosure and mixtures of the above, perferably metal shavings, metal sponge (such as Kurly Kate) and "Cannon" packing. The proper choice of packing material is critical since it has been discovered that numerous seemingly attractive materials will not function to give emulsions. Some that will not work are perforated glass beads, metal Fenske rings, Raschig rings (glass), steel wool, wooden straw. The usual guidelines for selecting materials to construct emulsification machines may be followed, i.e., it is better to use the material which is wetted by the continuous phase rather than the discontinuous phase of the emulsion to be formed. However, this consideration may not be critical if the fluids are sent into the packed tube by way of a pump to give strong mixing in the tube or the surfactants used are potent ones to produce the desired type of emulsion.

The length of the enclosure from entrance orifices to exit orifices, the amount of packing, the density of the packing, and the type of material packed is left to the discretion of the practitioner, depending on the type of emulsion desired, the density of the fluids used and the final ratio of internal to external phase desired.

The component fluids fed into the packed enclosure are fed into the enclosure by fluid feed means. These fluid feed means are typically selected from the group consisting of pumps for each individual fluid or group of fluids or gravity feed tanks and conduits or syringes for each fluid or group of fluids or any combination of the above. The preferred fluid feed means comprises pumps for the component fluids.

When preparing multiple emulsions of the water-oil-water or oil-water-oil type it is possible to use one enclosure wherein two dissimilar components are added simultaneously to the enclosure through relatively closely situated orifice (or through the same orifice) while the third component is added further downstream. For example, a water and oil combination can be added to the enclosure in sufficient ratio to give a water in oil (W/O) emulsion. Further downstream a separate water stream can be introduced, in sufficient quantity to result in the w/o emulsion being suspended in a continuous water phase resulting in a water/oil/water (w/o/w) emulsion.

Alternatively separate packed enclosures can be used to prepare each emulsion, enclosure 1 preparing the w/o emulsion and enclosure 2, using the w/o emulsion from enclosure 1 as a feedstream, adding water to the emulsion to yield the w/o/w emulsion. Many variations in this basic theme can be envisioned and all are included in the scope of this invention.

The fluids typically used in preparing a water-oil-water emulsion include an internal water phase wherein is dissolved or suspended any desirable material such as medicinals, acids, bases, etc. The oil phase typically comprises an oil component, such as paraffin oil, mineral oil, petroleum distillate, etc. or animal or vegetable oils, depending upon the use to which the ultimate composition will be put. In addition, the oil phase may contain a surfactant, i.e., an oil soluble surfactant of HLB smaller than 8, and/or a strengthening agent. This surfactant and/or strengthening agent may be the same material. The final water component is the suspending phase and may comprise the aqueous phase upon which the basic water-in-oil emulsion is to act (i.e., detoxification, minerals recovery, etc.) or it may comprise a diluent phase permitting easy injection either into the body (if in medicinal use) or into a well (if in drilling use).

The uses to which emulsions and liquid membranes can be put and the materials used in preparing emulsions and liquid membranes are discussed in detail in U.S. Pat. Nos. 3,389,078, 3,454,489, 3,617,546, 3,637,488, 3,719,590, 3,733,776, 3,740,315, 3,740,329, 3,779,907, 3,897,308, 3,942,527, 3,959,173, 3,969,265, 4,014,785, Re 27,888 and Re 28,002 all of which are incorporated herein by reference.

The emulsion prepared by use of the instant apparatus may have internal phase to external phase ratios ranging from 1:1 to greater than 32:1, preferably 1:1 to 3:1 for the low ratio type emulsions and 10:1 or greater, more preferably 17:1 or greater for the high ratio type emulsions. These apply to both water-in-oil and oil-in-water type emulsions. The emulsions prepared by the use of the instant apparatus may have droplet size from $0.1\mu$ to greater than $50\mu$, preferably from about $0.5\mu$ to $5\mu$ for the low ratio type emulsions and $6\mu$ to $20\mu$ for the high ratio type emulsions.

REPRODUCIBILITY OF THE PACKED TUBE DEVICE AND THE EFFECT OF THE AMOUNT OF PACKING MATERIALS

When metal sponge was used to pack the tube connected to a gear pump, the amount of the metal sponge used is important in determining the number of recycles needed to make a high ratio emulsion. Table I shows that when 9.5 gm of the metal sponge were used, 3 cycles of the feed phase (oil and water) were required to make an emulsion of 18/1 ratio (94% internal phase), whereas only 2 cycles were required when 28.5 gm of the metal sponge were used and 1 cycle was needed to emulsify more than 90% of the feed when 57 gm of the metal sponge were used. A cycle is defined as a once-through operation.

Table II shows the results of the duplicate runs. The drop sizes obtained are identical or close to those in Table I, indicating the excellent reproducibility of the packed tube device. In addition to drop size, flow rate (c.c./min.), pressure drop across the tube, and viscosities at various shear rates were measured and summarized in Tables II and III.

When the surfactant was changed from ENJ-3029 to ECA-4360, the emulsions made were quite similar in terms of drop size, time needed for complete emulsification, and viscosities at various shear rates (Table IV). Since these two polyamine surfactants are very close in chemical structure, these data further illustrate the reproducibility of the device's performance.

PACKED TUBE VS. KENICS AND PUMP

Although the packed tube, like Kenics mixer, is a type of static or motionless mixer, it is much more effective in making high ratio emulsions than Kenics because of the structure difference between the two devices. As discussed previously, the packed tube is much more densely packed in a random manner as compared to Kenics.

As shown in Table V, while it took 2 cycles to make a 17/1 W/O emulsion with a 1 or 2 metal sponge-packed tube, it took as many as 18 cycles to produce a similar emulsion with Kenics and 22 cycles with a gear pump alone (without connecting to the packed tube). The centrifugal pump tested simply could not produce such desired high ratio emulsion (Table VI).

It is interesting to note that the centrifugal pump was able to make the relatively low ratio emulsions in the class of the high ratio emulsions, such as 4/1 or 5/1, by first making a 2/1 ratio emulsion and then gradually increasing the ratio to 3/1, 4/1 and 5/1 with slow addition of the internal phase during the recirculation of the feed phase through the centrifugal pump. The ratio of 5/1 was the highest that could be achieved. When the not-completely-emulsified 6/1 ratio emulsion was recycled many times through the pump, a large portion of the emulsion was broken and the remaining emulsion had a ratio of roughly 2/1. The standard lab emulsification equipment used in the liquid membrane project—fluted beaker with marine propeller type stirrer was proved incapable of making high ratio emulsions.

PACKING MATERIALS

Besides metal sponge, nylon brush, animal hair brush and "cannon" type packing were found to be equally effective packing materials for making emulsions. The emulsions of 10/1 and 20/1 W/O ratios made with a tube packed with Nylon brush were quite similar to those made with metal sponge-packed tube as demonstrated by the viscosity vs. shear rate data (Table VII). The packed tube of 1 inch in diameter and 5 inch in length was attached to the discharge end of a 100–400 RPM gear pump. When the pump was used alone, it took 10 times longer than the packed tube in making the 10/1 W/O emulsion. It was totally unsuccessful in making 20/1 ratio emulsion even in a prolonged 1 hr. operation, whereas using a tube packed with either metal sponge or Nylon brush or animal hair brush made the 20/1 ratio emulsion in several minutes (Table VII).

"Cannon" packing is a small, half-cylindrical shape material. It is also very effective in forming high ratio emulsions, such as 17/1 W/O emulsion.

Using Berl Saddle, an emulsion of 20/1 ratio was made; whereas using stainless steel sponge, "Cannon" packing, and Nylon brush and bristle brush, emulsions of 33/1 ratio were successfully made.

Using the same experimental set-up and procedure, it was found that metal Fenske rings with 6 inch diameter, steel wool packing, wooden straw packing, and perforated glass beads, and Raschig rings did not work, i.e., they did not produce any emulsion with high internal to external phase ratio.

USE OF A PACKED TUBE TO MAKE LOW RATIO EMULSIONS

The packed tube is also effective in making low ratio emulsions with uniform droplet size. As shown in Table VIII when a tube which was packed with 2 metal sponges and connected to a centrifugal pump was used, drop size distribution of 2 to 3$\mu$ was observed after 2 cycles and 1–2$\mu$ after 3 cycles. When 3 metal sponges were used, 1–2$\mu$ drop size distribution was obtained in 1 cycle. In contrast, 4–14$\mu$ drop size distribution was produced when a centrifugal pump was used alone. (Table VIII) Similar wide drop size distribution was obtained with the lab standard set-up of fluted beaker and marine propeller type stirrer.

MAKING OIL-IN-WATER EMULSIONS

The following example shows that a metal sponge-packed tube is also effective in making oil-in-water emulsions.

The membrane phase was an aqueous solution of 1% Saponin, 70% glycerol and 29% water. The phase to be encapsulated was a mixture of toluene and heptane at a wt. ratio of 1/1. The wt. ratio of the encapsulated phase to the membrane phase was 4/1. Both of these phases blended at 4/1 ratio were sent to the packed tube via a gear pump. Specification of the pump is given in Table I.

A very stable emulsion of the o/w type was made by the pump-packed tube combination. Drop size range of the emulsion was from 4 to 12$\mu$ with an average drop size of 8$\mu$.

TABLE I

Effects of Recycling and Amount of Packing Material on Emulsification

Membrane Phase (M) = 8% ENJ-3029, 7% S100N, 85% Diesel Fuel
Internal Phase (IP) = 2% KCl
M/IP Wt. Ratio = 1/17.6
Gear Pump used to connect with the packed tube:
Gearchem Model No. G 6ACT2KT Made by ECO Pump Corp. Capacity 1200 RPM driven by air; 5.3 GPM at 10 psig.
Packing Material = Metal sponge (M.S.), "Kurly Kate", No. 207, made by Kurly Kate Corporation, Chicago
t = 25° C.

| Wt. of Packing (gm) | 9.5 (⅓ of 1 M.S.) | | | 28.5 (1 M.S.) | | 57 (2 M.S.) | |
|---|---|---|---|---|---|---|---|
| No. of Cycle | 1 | 2 | 3 | 1 | 2 | 1 | 2 |
| % Emulsification | 70 | 90 | 100 | 80 | 100 | 90–95 | 100 |
| Drop Size ($\mu$) | — | 10,14,24 | 8,10,20 | — | 10,12,20 | — | 8,14,18 |

TABLE II

Pressure Drop, Flowrate, and Drop Size Studies

M, IP and M/IP = Same as in Table I
Packed Tube connected to ECO gear pump.

TABLE II-continued

Pressure Drop, Flowrate, and Drop Size Studies (Ia) 1 Metal Sponge (M.S.), wt. = 28.5 gm, packing length (p.l.) = 12.5 cm, packing diam. (p.d.) = 2.54 cm, packing volume (p.v.) = 63.3 cm.

| Cycle | p(psi) | Flowrate (ml/min) | Drop Size (μ) (Smallest, avg., largest) |
|---|---|---|---|
| 1st | 5.8 | 24.00 | 40, 80, 120 |
| 2nd | 2.9–4.4 | 200 | 10, 12, 20 |
| 3rd | 5.8 | 17 | 8, 10, 18 |

(Ib) 1 M.S., wt. = 28.5 gm, p.l. = 45 cm, p.d. = 1.6 cm, p.v. = 90.5 $cm^3$

| | | | |
|---|---|---|---|
| 1st | 5.8–7.3 | 183.3 | 8, 18, 22 |
| 2nd | | 81 | 6, 12, 12 |

(II) 2 M.S., wt. = 63 gm, p.l. = 28 cm, p.d. = 2.54 cm, p.v. = 141.6 $cm^3$

| | | | |
|---|---|---|---|
| 1st | 9.4–10.2 | 1320 | 14, 40, 52 |
| | 5.8 | 75 | 8, 12, 18 |

TABLE III

Viscosity of Emulsions vs. Shear Rate

| Shear Rate ($Sec^{-1}$) | Viscosity (cp) Emulsion Ia | Emulsion Ib | Emulsion II |
|---|---|---|---|
| 5.1 | 6300 | 5000 | 4800 |
| 10.2 | 3000 | 3750 | 3150 |
| 170.0 | 450 | 540 | 435 |
| 240 | 300 | 345 | 278 |
| 510 | 20 | >300 | 220 |
| 1020 | 10 | >300 | >150 |
| 5.1 | 7500 | 7200 | 8000 |
| 10.2 | 4250 | 5000 | 5500 |

TABLE IV

Emulsification with Different Membrane Formulations $M_1$ = 8% ENJ 3029, 92% Diesel Oil (D.O.)
$M_2$ = 8% ECA 4360, 92% D.O.
IP = 2% KCl sol'n
M/IP = 1/20
Packed Tube = 1 metal sponge
t = 25° C.

| | Emulsion No. 1 (Using $M_1$) | | Emulsion No. 2 (Using $M_2$) |
|---|---|---|---|
| Drop Size | 10–20 μ | | 10–30 μ |
| Emulsification Time (Min.) | 3 | | 3 |
| Viscosity | rpm | cp | cp |
| | 3 | 3700 | 2400 |
| | 6 | 2800 | 2100 |
| | 100 | 405 | 330 |
| | 200 | 270 | 225 |
| | 300 | 200 | 190 |
| | 600 | >150 | 150 |
| | 3 | 5500 | 4500 |
| | 6 | 4000 | 3250 |

TABLE V

Emulsification by Kenics and Gear Pump

M = 8% ENJ 3029, 7% S100N, 85% D.O.
IP = 2% KCl sol'n
M/IP = 1/16.7
Gear Pump = see Table I
(I) Kenics (2" diam. 6 stages) and gear pump

| No. of Cycles | % Emulsification | Drop Size (μ) |
|---|---|---|
| 16th | 80 | 6–20 |
| 17 | 98 | |
| 18 | 100 | 6–10 |
| (II) Gear Pump | | |
| 20th | 95 | |
| 22nd | 100 | 6–20 |

TABLE VI

Emulsification by Centrifugal Pump Alone

M = 10% ENJ 2039, 90% Diesel Oil
IP = 2% KCl
Centrifugal pump = Century, 3/4 HP, 3450 RPM.
(I) M/IP = 1/4 (M and IP were mixed at this ratio and fed into the pump).

| No. of Cycles | Unemulsified IP (≈%) |
|---|---|
| 1 | 63 |
| 2 | 45 |
| 3 | 50 |
| 4 | 40 |
| 5 | 48 |
| 10 | 65 |

The above data indicate that the emulsion made had a M/IP ratio ≈ 1/2.

(II) M/IP = 1/2 → 1/3 → 1/4 → 1/5 → 1/6 (M and IP were mixed at the 1/2 ratio and fed into the pump. When emulsion was formed, additional IP was added to change the ratio to 1/3, 1/4, etc.)

| M/IP | No. of Cycles | Unemulsified IP | Diam. of Emulsion Drop (μ) |
|---|---|---|---|
| 1/2 | 1 | 10 | |
| | 2 | 0 | 0.5–2 |
| 1/3 | 1 | 0 | 1–2 |
| 1/4 | 1 | 0 | — |
| 1/5 | 1 | 0 | 1–12 |
| 1/6 | 1 | 100 (additional IP was not emulsified) | |

When the existing emulsion was recycled many times, almost half of the emulsion was broken, the emulsion left had a M/IP ratio ≈½.

TABLE VII

M = 8% ENJ 3029, 7% S100N, 85% Diesel Oil
IP = 2% KCl Sol'n
(I) M/IP =S100N, 1/10
(1) Gear Pump and Tube packed with nylon needles (brush)

| Time Needed to Make Emulsion (min) | Drop Size (μ) | Shear Rate ($Sec.^{-1}$) | Viscosity (cp) |
|---|---|---|---|
| 3 | 8–12 | 5 | 2800 |
| | | 10 | 1600 |
| | | 170 | 420 |
| | | 340 | 270 |
| | | 510 | 225 |
| | | 1020 | 150 |
| | | 5 | 3900 |

(2) Gear Pump and tube packed with metal sponge

| Time Needed to Make Emulsion (min) | Drop Size (μ) | Shear Rate ($Sec.^{-1}$) | Viscosity (cp) |
|---|---|---|---|
| 3–4 | 8–12 | 5 | 2800 |
| | | 10 | 1600 |
| | | 170 | 420 |
| | | 340 | 270 |
| | | 510 | 220 |
| | | 1020 | 145 |
| | | 5 | 4500 |
| | | 10 | 2750 |
| (3) Gear Pump | | | |
| 30 | 10–20 | 5 | 1500 |

(II) M/IP = 1/20
(1) Gear Pump and tube packed with nylon needles

| | | | |
|---|---|---|---|
| 7 | 8–12 | 5 | 7000 |
| | | 10 | 4200 |
| | | 170 | 510 |
| | | 340 | 270 |
| | | 510 | 190 |
| | | 1020 | 145 |
| | | 5 | 10000 |
| | | 10 | 6500 |

(2) Gear Pump and tube packed with metal sponge

| Time Needed to Make Emul- | Drop Size | Shear Rate | Viscos-ity | cp at 5 |
|---|---|---|---|---|

TABLE VII-continued

| sion (min.) | (μ) | (Sec$^{-1}$) | (cp) | t° F | °sec$^{-1}$ |
|---|---|---|---|---|---|
| 3 | 8–22 | 5 | 3300 | 80 | 6500 |
| | | 10 | 2350 | 86 | 5000 |
| | | 170 | 360 | 102 | 4300 |
| | | 340 | 233 | 114 | 4000 |
| | | 510 | 220 | 138 | 3500 |
| | | 1020 | >150 | 154 | 2800 |
| | | 5 | 6000 | 164 | 2500 |
| | | 10 | 4250 | 180 | 2800 |
| | | | | 190 | 4800 |
| | | | | 196 | 4900 |

(3) Gear Pump

| Time Needed to Make Emulsion (min.) | Drop Size (μ) | Shear Rate (Sec.$^{-1}$) | Viscosity (cp) |
|---|---|---|---|
| 60 | no emulsion | — | — |

Notes:
(1) Animal hair brush and "Cannon" packing were also found to be effective in making high ratio emulsions. "Cannon" packing is half-cylindrical shell with 4 mm height, 3.2 mm diam. and 0.5 mm diam. holes on shell.
(2) The standard lab equipment, fluted beaker with marine propeller-type stirrer, was ineffective in making high ratio emulsions.

TABLE VIII

Using Packed Tube to Make Low Ratio of W/O Emulsions

M = 1% ENJ-3029, 5% Lix 64 N, 11% S100N, 83% Isopar M
Internal Reagent for Cu Extraction, IR = 14% $H_2SO_4$
4,
13% $CuSO_4 \cdot 5H_2O$, 73%

M/IR wt. Ratio = 1/1
The packed tube was connected to the Century centrifugal pump (3/4 H.P.)
(I) Packed tube = 2.54 cm diam., 14 cm length
Packing materials — a = Metal sponge
b = "Cannon" packing (half-cylindrical shells with 4 mm height, 3.2 mm diam, 0.5 mm diam. holes on shell)

| No. of Cycles | Δ p (psi) a | Δ p (psi) b | Drop Size (μ) a | Drop Size (μ) b |
|---|---|---|---|---|
| 1 | 1.5 | 1.5 | 2–5 | 2–5 |
| | 2.9 | 2.9 | 2–3 | 2–3 |
| | 2.9–4.4 | 2.9 | 1–2 | 1–2 |
| | 2.9–4.4 | 2.9–4.4 | 1–2 | 1–2 |

(II) Packed tube = 2.54 cm diam., 28 cm length, wt. = 63 gm (2 m.s.)

| Cycle | Δp (psi) | Velocity (cc/min) | Drop Size (μ) |
|---|---|---|---|
| 1 | 2.9 | 1200 | 2–5 |
| 2 | 2.9–4.4 | — | 2–3 |
| 3 | 2.9–4.4 | 784 | 1–2 |
| 4 | 2.9–4.4 | 775 | 1–2 |
| 5 | 4.4 | — | 1–2 |

Note: Δp = 1.5 psi when pure water was recirculated.
(III) Packed tube = 3 metal sponges with a total weight of 85.5 gm.

| Method of Making Emulsion (No Recycle) | Drop Size (μ) |
|---|---|
| (1) By centrifugal pump alone | 4–14 |
| (2) By centrifugal pump and packed tube | 1–2 |

What is claimed is:

1. A method for generating emulsions of immiscible fluids, which emulsions have an internal to external phase ratio from 1:1 to greater than 32:1 and a droplet size of from μ to greater than 50μ, which comprises simultaneously passing the immiscible fluids through an enclosure having at least one entrance orifice and at least one exit orifice thereby permitting the flow of said fluids through the enclosure along one of its axis from the entrance to the exit orifice, which enclosure is of any cross-sectional profile perpendicular to the axis of fluid flow, which emclosure is packed with metal sponge which causes the rapid and repeated mixing and remixing of said immiscible fluids in the enclosure and results in the formation of the desired emulsion.

2. The method of claim 1 further comprising feeding the emulsion discharged from the exit orifice to the entrance orifice of a second packed enclosure to which is fed a third immiscible fluid resulting in the formation of a multiple phase emulsion.

3. The method of claim 1 wherein the emulsion has an internal phase to external phase ratio of 10:1 or greater.

4. The method of claim 3 wherein the emulsion has a droplet size of from about 6μ to 20μ.

5. The method of claim 1 wherein the emulsion has an internal phase to external phase ratio of 17:1 or greater.

6. A method for generating emulsions of immiscible fluids, which emulsions have an internal to external phase ratio of from 1:1 to greater than 32:1 and a droplet size of from 1μ to greater than 50μ, which comprises simultaneously passing the immiscible fluids through an enclosure having at least one entrance orifice and at lease one exit orifice thereby permitting the flow of said fluids through the enclosure along one of its axis from the entrance to the exit orifice, which enclosure is of any cross-sectional profile perpendicular to the axis of fluid flow, which enclosure is packed with metal shavings which cause the rapid and repeated mixing and remixing of said immiscible fluids in the enclosure and results in the formation of the desired emulsion.

7. The method of claim 6 further comprising feeding the emulsion discharged from the exit orifice to the entrance orifice of a second packed enclosure to which is feed a third immiscible fluid resulting in the formation of a multiple phase emulsion.

8. The method of claim 6 wherein the emulsion has an internal phase to external phase ratio of 10:1 or greater.

9. The method of claim 8 wherein the emulsion has a droplet size of from about 6μ to 20μ.

10. The method of claim 6 wherein the emulsion has an internal phase to external phase ratio of 17:1 or greater.

11. A method for generating emulsions of immiscible fluids, which emulsions have an internal to external phase ratio of from 1:1 greater than 32:1 and a droplet size of from 1μ to greater than 50μ, which comprises simultaneously passing the immiscible fluids through an enclosure having at least one entrance orifice and at least one exit orifice thereby permitting the flow of said fluids through the enclosure along one of its axis from the entrance to the exit orifice, which enclosure is of any cross-sectional profile perpendicular to the axis of fluid flow, which enclosure is packed with ceramic chips, which causes the rapid and repeated mixing and remixing of said immiscible fluids in the enclosure and results in the formation of the desired emulsion.

12. The method of claim 11 further comprising feeding the emulsion discharged from the exit orifice to the entrance orifice of a second packed enclosure to which is fed a third immiscible fluid resulting in the formation of a multiple phase emulsion.

13. The method of claim 11 wherein the emulsion has an internal phase to external phase ratio of 10:1 or greater.

14. The method of claim 13 wherein the emulsion has a droplet size of from about 6μ to 20μ.

15. The method of claim 11 wherein the emulsion has an internal phase to external phase ratio of 17:1 or greater.

16. A method for generating emulsions of immiscible fluids, which emulsions have an internal to external phase ratio of from 1:1 to greater than 32:1 and a droplet size of from 1μ to greater than 50μ, which comprises simultaneously passing the immiscible fluids through an enclosure having at least one entrance orifice and at least one exit orifice thereby permitting the flow of said fluids through the enclosure along one of its axis from the entrance to the exit orifice, which enclosure is of any cross-sectional profile perpendicular to the axis of fluid flow, which enclosure is packed with Cannon packing which causes the rapid and repeated mixing and remixing of said immiscible fluids in the enclosure and results in the formation of the desired emulsion.

17. The method of claim 16 further comprising feeding the emulsion discharged from the exit orifice to the entrance orifice of a second packed enclosure to which is fed a third immiscible fluid resulting in the formation of a multiple phase emulsion.

18. The method of claim 16 wherein the emulsion has an internal phase to external phase ratio of 10:1 or greater.

19. The method of claim 18 wherein the emulsion has a droplet size of from about 6μ to 20μ.

20. The method of claim 16 wherein the emulsion has an internal phase to external phase ratio of 17:1 or greater.

21. A method for generating emulsions of immiscible fluids, which emulsions have an internal to external phase ratio of from 1:1 to greater than 32:1 and a droplet size of from 1μ to greater than 50μ, which comprises simultaneously passing the immiscible fluids through an enclosure having at least one entrance orifice and at least one exit orifice thereby permitting the flow of said fluids through the enclosure along one of its axis from the entrance to the exit orifice, which enclosure is of any cross-sectional profile perpendicular to the axis of fluid flow, which enclosure is packed with animal hair or plastic brush, which causes the rapid and repeated mixing and remixing of said immiscible fluids in the enclosure and results in the formation of the desired emulsion.

22. The method of claim 21 further comprising feeding the emulsion discharged from the exit orifice to the entrance orifice of a second packed enclosure to which is fed a third immiscible fluid resulting in the formation of a multiple phase emulsion.

23. A method of claim 21 wherein the emulsion has an internal phase to external phase ratio of 10:1 or greater.

24. The method of claim 23 wherein the emulsion has a droplet size of from about 6μ to 20μ.

25. The method of claim 24 wherein the emulsion has an internal phase to external phase ratio of 17:1 or greater.

26. A method for generating emulsions of immiscible fluids, which emulsions have an internal to external phase ratio of from 1:1 to greater than 32:1 and a droplet size of from 1μ to greater than 50μ, which comprises simultaneously passing the immiscible fluids through an enclosure having at least one entrance orifice and at least one exit orifice thereby permitting the flow of said fluids through the enclosure along one of its axis from the entrance to the exit orifice, which enclosure is of any cross-sectional profile perpendicular to the axis of fluid flow, which enclosure is packed with metal tubes shorter than the internal diameter of the enclosure which causes the rapid and repeated mixing and remixing of said immiscible fluids in the enclosure and results in the formation of the desired emulsion.

27. The method of claim 26 further comprising feeding the emulsion discharged from the exit orifice to the entrance orifice of a second packed enclosure to which is fed a third immiscible fluid resulting in the formation of a multiple phase emulsion.

28. The method of claim 26 wherein the emulsion has an internal phase to external phase ratio of 10:1 or greater.

29. The method of claim 28 wherein the emulsion has a droplet size of from about 6μ to 20μ.

30. The method of claim 26 wherein the emulsion has an internal phase to external phase ratio of 17:1 or greater.

31. A method for generating emulsions of immiscible fluids, which emulsions have an internal to external phase ratio of from 1:1 to greater than 32:1 and a droplet size of from 1μ to greater than 50μ, which comprises simultaneously passing the immiscible fluids through an enclosure having at least one entrance orifice and at least one exit orifice thereby permitting the flow of said fluids through the enclosure along one of its axis from the entrance to the exit orifice, which enclosure is of any cross-sectional profile perpendicular to the axis of fluid flow, which enclosure is packed with Berl Saddle, which causes the rapid and repeated mixing and remixing of said immiscible fluids in the enclosure and results in the formation of the desired emulsion.

32. The method of claim 31 further comprising feeding the emulsion discharged from the exit orifice to the entrance orifice of a second packed enclosure to which is fed a third immiscible fluid resulting in the formation of a multiple phase emulsion.

33. The method of claim 31 wherein the emulsion has an internal phase to external phase ratio of 10:1 or greater.

34. The method of claim 33 wherein the emulsion has a droplet size of from about 6μ to 20μ.

35. The method of claim 31 wherein the emulsion has an internal phase to external phase ratio of 17:1 or greater.

* * * * *